US005265839A

United States Patent [19]

Buckley

[11] Patent Number: 5,265,839

[45] Date of Patent: Nov. 30, 1993

[54] UMBRELLA SUPPORT MEANS FOR USE WITH A GOLF CADDY CAR

[76] Inventor: Liam Buckley, 33 Delaford Avenue, Knocklyon, Templeogue, Dublin 16, Ireland

[21] Appl. No.: 879,286

[22] Filed: May 7, 1992

[30] Foreign Application Priority Data

May 20, 1991 [IE] Ireland ..... 1719/91
Oct. 29, 1991 [IE] Ireland ..... 3781/91

[51] Int. Cl.[5] ..... A45B 25/28
[52] U.S. Cl. ..... 248/538; 248/541
[58] Field of Search ..... 248/538, 534, 535, 540, 248/541, 128, 96; 224/274, 915; 180/DIG. 6, DIG. 5

[56] References Cited

U.S. PATENT DOCUMENTS

| | | | |
|---|---|---|---|
| 640,446 | 1/1900 | Converse | 248/541 X |
| 3,602,466 | 8/1971 | Drowns | 248/514 |
| 3,709,532 | 1/1973 | Caligiuri . | |
| 3,866,934 | 2/1975 | Braun | 280/DIG. 6 X |
| 4,455,030 | 6/1984 | Rosen | 248/534 X |
| 4,550,930 | 11/1985 | Proffit | 224/274 X |
| 4,570,894 | 2/1986 | Miele | 248/284 X |
| 4,653,952 | 3/1987 | Hopkins . | |
| 4,711,422 | 12/1987 | Ianez | 248/515 |
| 4,720,074 | 1/1988 | Gard et al. . | |
| 4,887,786 | 12/1989 | Stokes | 248/538 X |
| 5,039,056 | 8/1991 | Paxton | 248/538 X |

FOREIGN PATENT DOCUMENTS

| | | |
|---|---|---|
| 8709033 | 10/1987 | Fed. Rep. of Germany . |
| 3721552 | 2/1988 | Fed. Rep. of Germany . |
| 8714432 | 3/1988 | Fed. Rep. of Germany . |
| 865472 | 4/1961 | United Kingdom . |
| 1006956 | 10/1965 | United Kingdom . |
| 2059495 | 4/1981 | United Kingdom . |
| 2102056 | 1/1983 | United Kingdom . |

*Primary Examiner*—Ramon O. Ramirez
*Attorney, Agent, or Firm*—Birch, Stewart, Kolasch & Birch

[57] ABSTRACT

A tubular part, into which the handle of an umbrella or a part of some other device can be inserted downwardly, is fixed to or removably connected to, a clamping part including upper and lower cup-shaped portions held together to form a hollow body resembling a golf ball but larger. A recess in the lower cup-shaped portion receives a bar, for example a bar forming part of a golf caddy car. A U-shaped clamping member has a base which presses on the bar and two limbs which pass on opposite sides of the bar into the lower cup-shaped portion where nuts are screwed on to them to clamp the lower cup-shaped portion to the bar. The upper cup-shaped portion includes a clock.

11 Claims, 5 Drawing Sheets

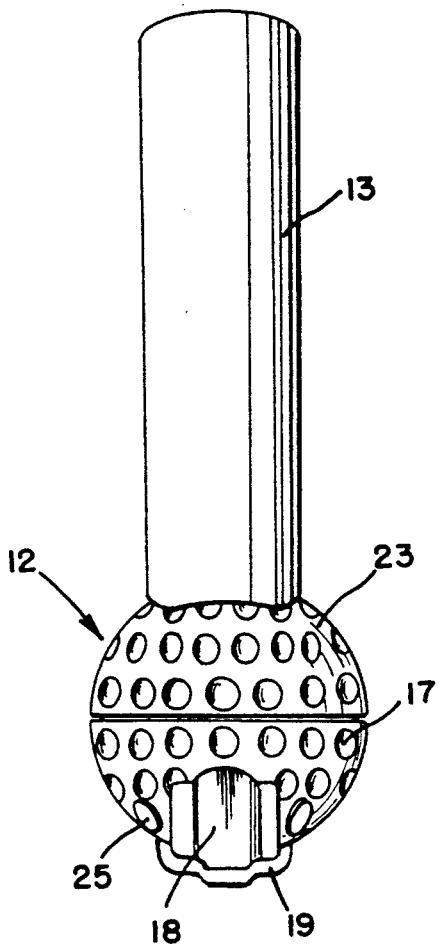
FIG. 5
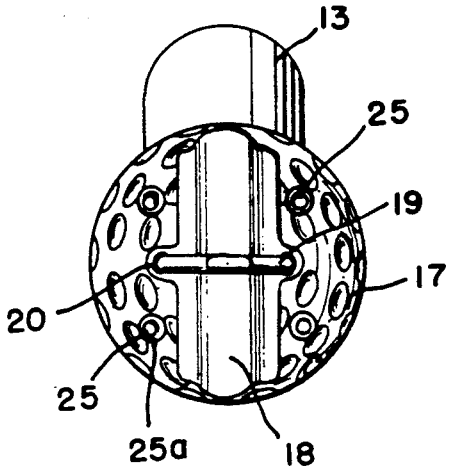
FIG. 6
FIG. 7
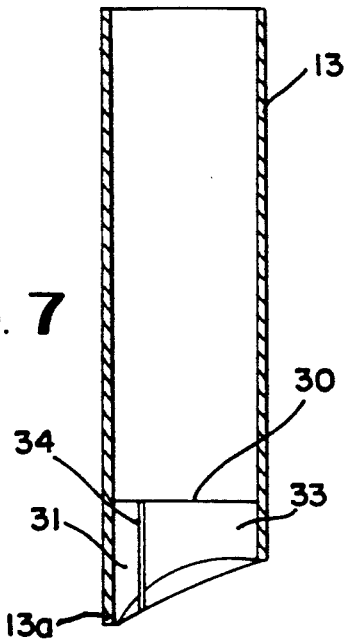
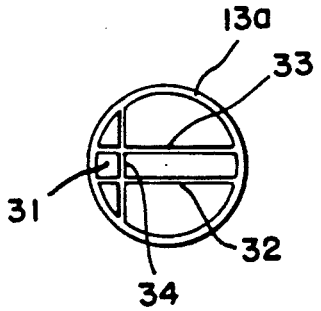
FIG. 8

UMBRELLA SUPPORT MEANS FOR USE WITH A GOLF CADDY CAR

BACKGROUND OF THE INVENTION

1. Field of the Invention

This invention relates to apparatus for supporting a device from a bar. The device could be an umbrella or parasol or a flag or any other device having an elongate part at its lower extremity which can be inserted in a tubular part to support the device. The bar could be part of a golf caddy car, an infant's perambulator or push-chair or an invalid's wheelchair, to give but a few examples of the many possible applications of the present invention. However, the following description deals only with an application in which an umbrella is to be supported on a golf caddy car.

2. Description of Related Art

Golfers are familiar with the many difficulties presented to the golfer when playing golf in the rain. One of the problems is that while one may use an umbrella to protect oneself from the rain one is obliged to close the umbrella and lay it down on the wet ground or stick the umbrella into the ground, while one is playing a golf shot. One is, therefore, regularly opening and closing a wet umbrella, laying it down and picking it up, a procedure which is generally not helpful to achieving a good score.

SUMMARY OF THE INVENTION

It is now proposed to minimise the problems associated with the use of umbrellas during a golf game in wet conditions by providing an umbrella support means for use with a golf caddy car. Most golfers use a caddy car to transport their golf bag around a golf course and it is envisaged that an umbrella support means attached to the caddy car would readily provide one solution to the problem by giving the golfer an available support means for the umbrella while the golfer is playing a golf shot.

According to a first aspect of the present invention, there is provided apparatus for supporting a device from a bar, comprising a clamping part for clamping on the bar, a tubular part, with a free end open for insertion and withdrawal of a portion of the device into and from the tubular part, and connecting means for connecting the clamping part to the tubular part so that the tubular part rises from the clamping part and has its free end uppermost.

Preferably, the clamping part comprises first and second cup-shaped portions, fastening means for fastening the cup-shaped portions together to form a hollow body and a substantially U-shaped clamping member the legs of which pass through respective holes in the first cup-shaped portion into the interior of the hollow body, with the base of the U outside the hollow body and able to press on the bar to clamp the first cup-shaped portion to the bar.

The cup-shaped portions are preferably such that the hollow body has an appearance somewhat like that of a golf ball, its surface being white and dimpled, although the hollow body may be larger than a golf ball in the case where an umbrella is to be supported on a golf caddy car. There may be a recess in the first cup-shaped portion to receive part of the bar and/or an elongate passageway in the second cup-shaped portion which receives one end of a rod which is fixed to the tubular part so that the tubular part may readily be connected to and disconnected from the second cup-shaped portion.

According to a second aspect of the invention there is provided a golfer's caddy car having a handle part, for use in propelling the caddy car, a bar part adjacent said handle part, a clamping part clamped on the bar part and a tubular part, extending upwardly from the clamping part and having uppermost a free end which is open.

Preferably the tubular part is so connected to the clamping part that it may readily be detached from it and stored in a golf bag when not required, leaving the clamping part secured to the caddy car.

BRIEF DESCRIPTION OF THE DRAWINGS

Two examples in accordance with the first and second aspects of the invention are described below with reference to the accompanying drawings, in which:

FIGS. 3 to 6 show, respectively, front, side, rear and underneath plan views of the support means;

FIG. 7 is a sectional side view of a tubular part of the support means;

FIG. 8 shows an underneath plan view of the tubular part;

DETAILED DESCRIPTION OF PREFERRED EMBODIMENTS

Figure 1:
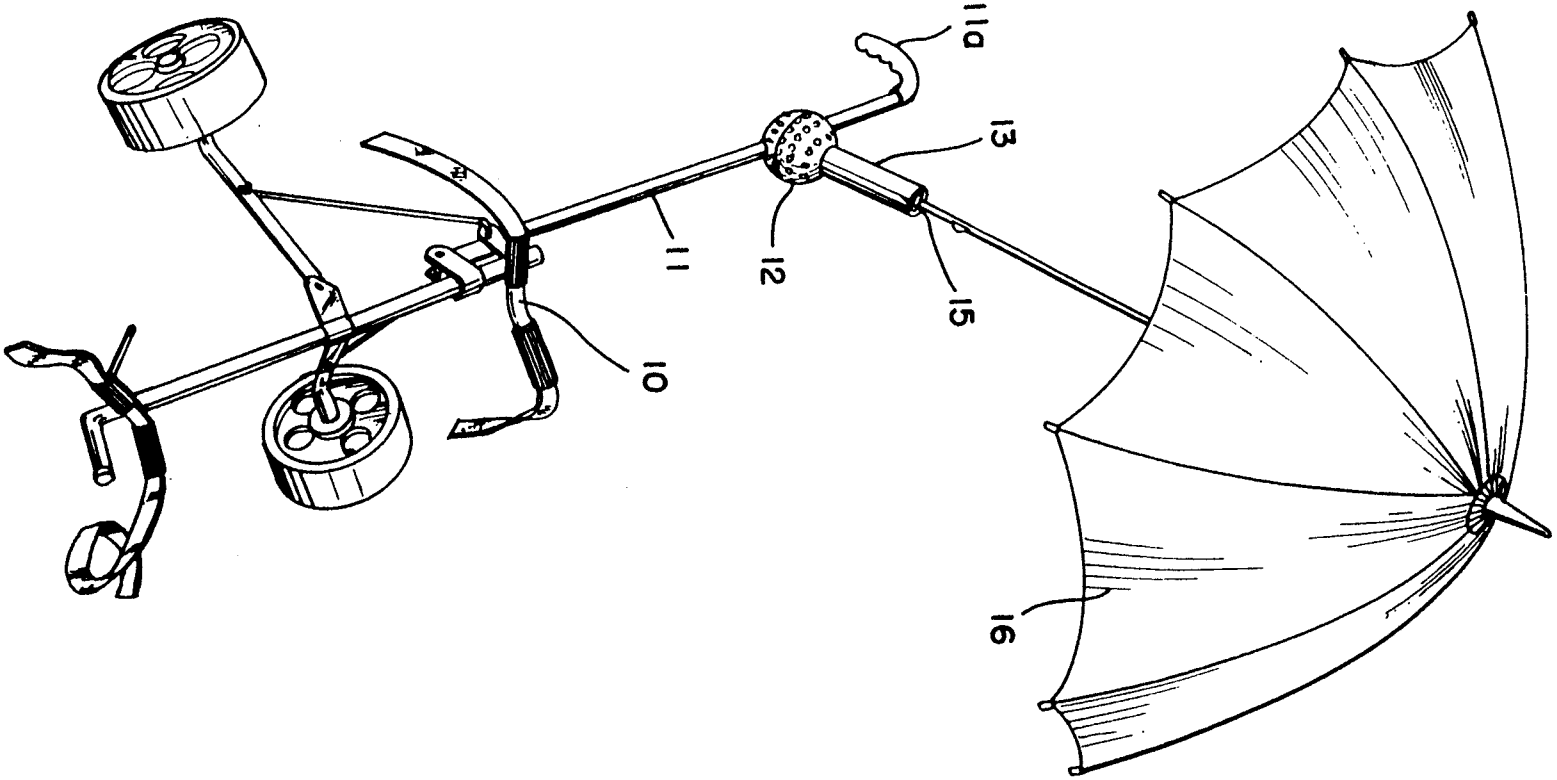
FIG. 1 shows a perspective view of a golf caddy car and support means on the caddy car supporting an umbrella.
Figure 3:
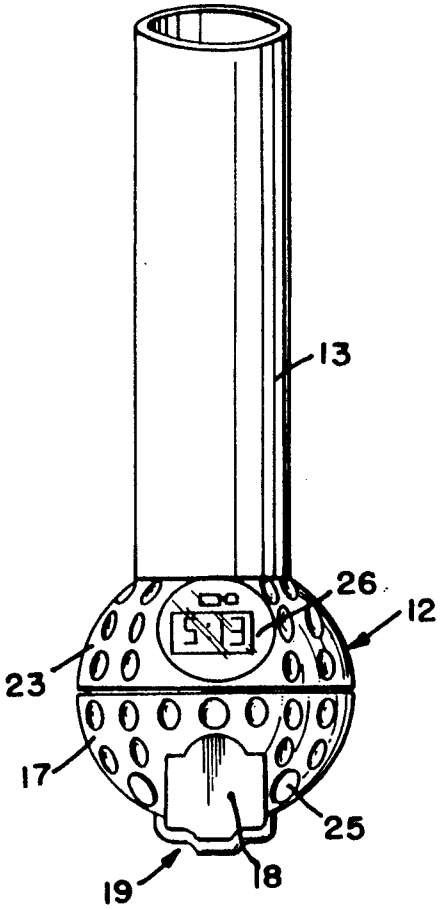
Figure 4:
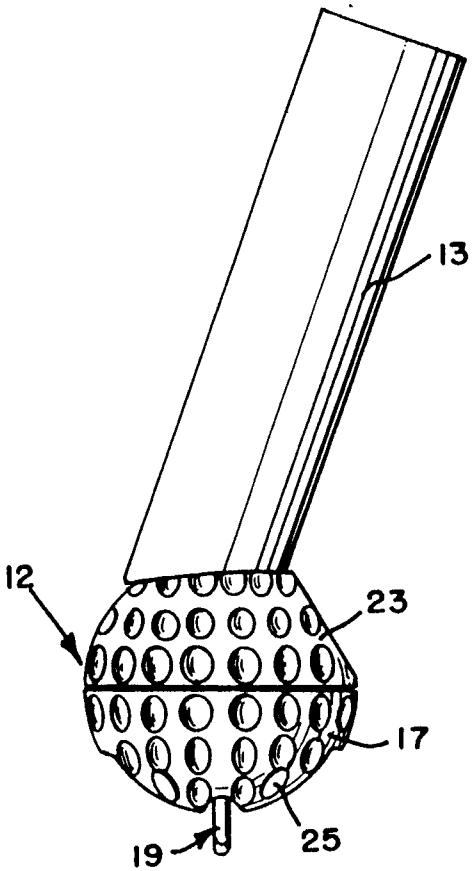
Figure 2:
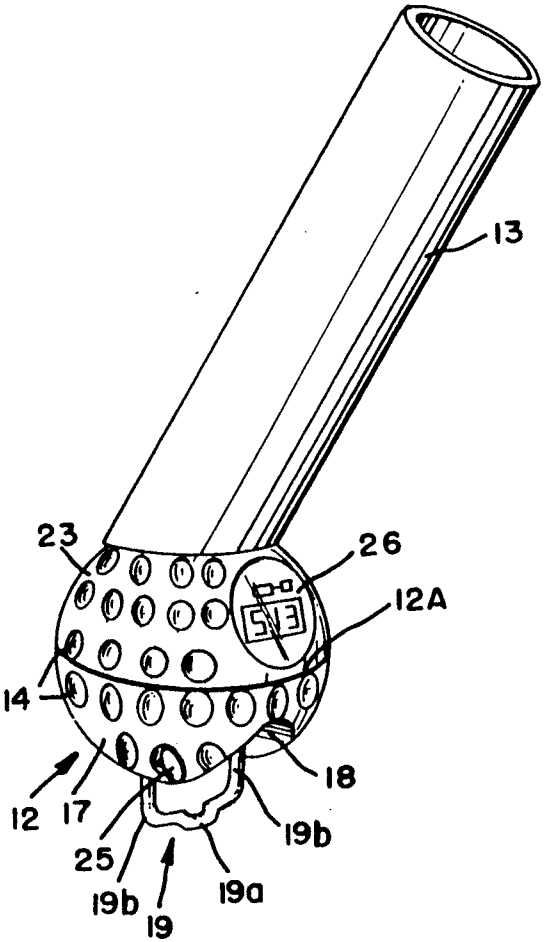
FIG. 2 shows a perspective view of the support means.

FIG. 1 shows a conventional caddy car 10 having an inclined bar 11 with a handle part or grip 11*a* at its upper end. Apparatus for supporting an umbrella 16 from the bar 11 comprises a clamping part 12 for clamping on the part of bar near the handle part 11*a*, a tubular part 13, with a free end open and uppermost, and connecting means (not shown in FIG. 1) connecting the clamping part 12 to the tubular part 13 while permitting the tubular part 13 to be disconnected from the clamping part 12 by simply lifting it. The handle 15 of the umbrella 16 can be inserted in the open end of the tubular part 13 and held within the part 13 until it is lifted out of the latter.

The clamping part 12 is substantially spherical except where a recess 18 is formed in it to receive part of the bar 11. It is made of moulded plastics material, for example PVC, and it is white and formed with dimples 14 in its outer surface. It therefore looks rather life a golf ball but is larger than a go)f ball. It comprises an upper cup-shaped portion 23 and a lower cup-shaped portion 17 formed with the recess 18, both portions 23 and 17 being substantially hemispherical and the portion 17 having a circular flange 39 surrounding its mouth which projects upwardly into the mouth of the portion 23, where it is accommodated within an annular recess in the wall of the portion 23. Since the flange has a greater height than the recess, a gap 12*a* is formed between the upper and lower parts of the external surface of the clamping part 12.

In order to clamp the cup-shaped portion 17 to the bar 11 there is provided a substantially U-shaped claiming member 19, the base 19*a* of the U being always outside the clamping part 12 and having a curved part to receive the bar 11 while straight and parallel legs 19*b* of the member 19 are caused to pass on opposite sides of the bar and through holes 20 (see FIG. 6) in the cup-shaped portion 17 after the latter has been placed on the caddy car with the bar 11 partly in the recess 18. Then nuts 21 are placed on screw-threaded ends 22 of the legs 19*b* and tightened so that the base 19*a* of the member 19 is pressed against the bar 11 and clamps the cup-shaped portion 17 to the bar 11.

The holes 20 have their open ends in a locally widened part of the recess 18, as shown in FIG. 6. The holes 20 are in fact the passages through tubular columns 40 in the cup-shaped portion 17. These columns extend into the cup-shaped portion 23 and are connected together by a strengthening web 41.

Figure 10:
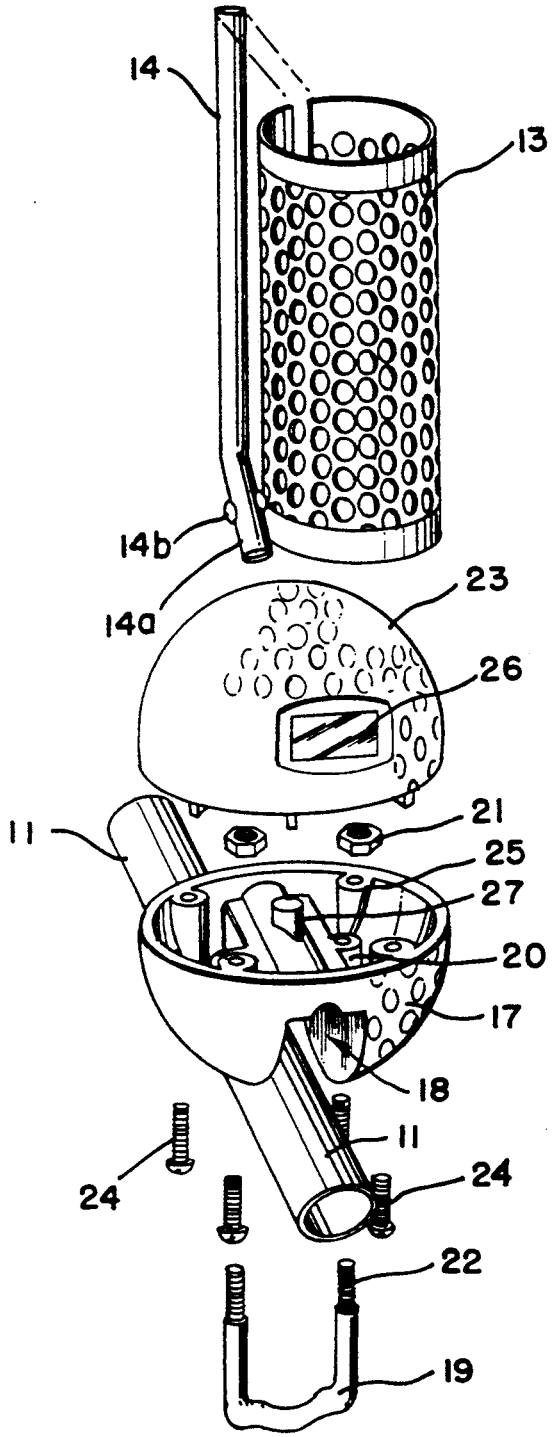
FIG. 10 shows a perspective exploded view of a second of support means for an umbrella

In order to fasten the cup-shaped portions 17 and 23 together there are four screws 24 (see FIG. 10). The cup-shaped portion 17 includes tubular columns 42 which have internal shoulders 25*a* at their upper ends against which heads of the screws 24 bear. The screws are screwed into brass inserts 44 in tubular sockets 43 in the cup-shaped portion 23.

The screws are inserted into the columns 42 through open ends 25 of the passageways through the columns.

A battery-driven digital clock 26 lies within the clamping part 12 and 13 visible through a window 49 in a flat surface of the cup-shaped portion 23 of the clamping part. Ribs 47 and 48 integral with the portion 23 support the clock and a vane 46 integral with the portion 17 prevent its being pushed inwardly. The portions 17 and 23 have further strengthening ribs 37 and 38.

The tubular part 12 is open at the free, upper end and is partly open at the lower end 13*a* which is cut off obliquely and concave so that the part 13 sits neatly on the cup-shaped portion 23. At the lower end of the part 13 there are internal ribs 32, 33 and 34 which form a stop 30 for the handle of the umbrella and form a channel 31 for the upper part of a rod 14, which is of square cross-section and is fixed to the part 13 by an adhesive. The rod 14 has a lower part 14*a* which is inclined by about 170° with respect to the upper part and is inserted in the passageway through a tube 27 of square internal and external shape which is integral with the cup-shaped portion 23 and extends out of its mouth and extends into a shorter tube 45, also of square internal and external shape, in the cup-shaped portion 17. The tubular part 13 cannot rotate with respect to the clamping part 12 but can readily be lifted away from it.

The tubular part 13 is preferably of the same plastics material as the clamping part 12 and the rod 14 and clamping member 19 are preferably of steel. However, the part 13 could be of steel too. Another possibility is to form the parts 13 and 23 as a single moulding.

Figure 9A:
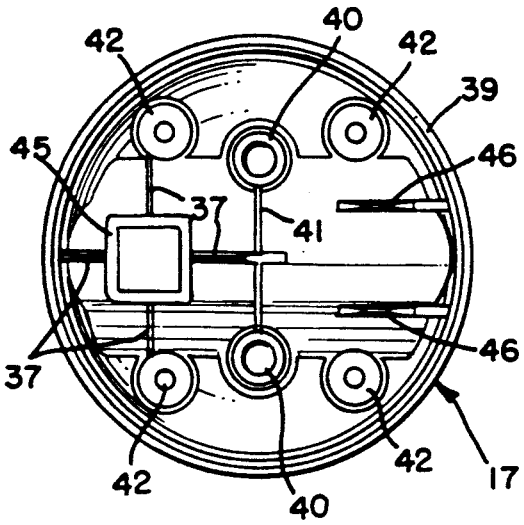
FIG. 9A shows an underneath plan view of an upper part of the support means.
Figure 9B:
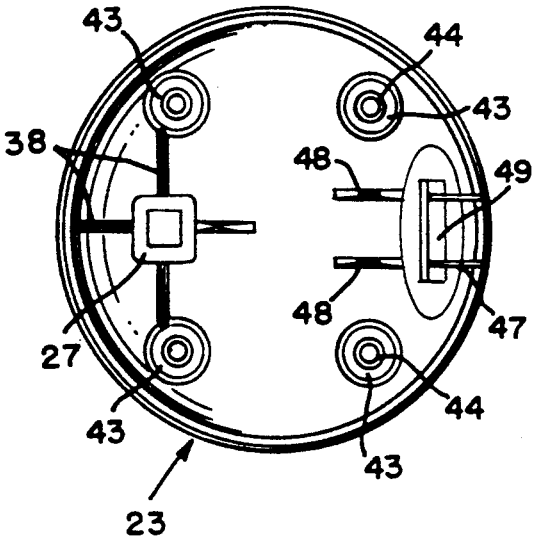
FIG. 9B shows a plan view of a lower part of the support means.
Figure 9:
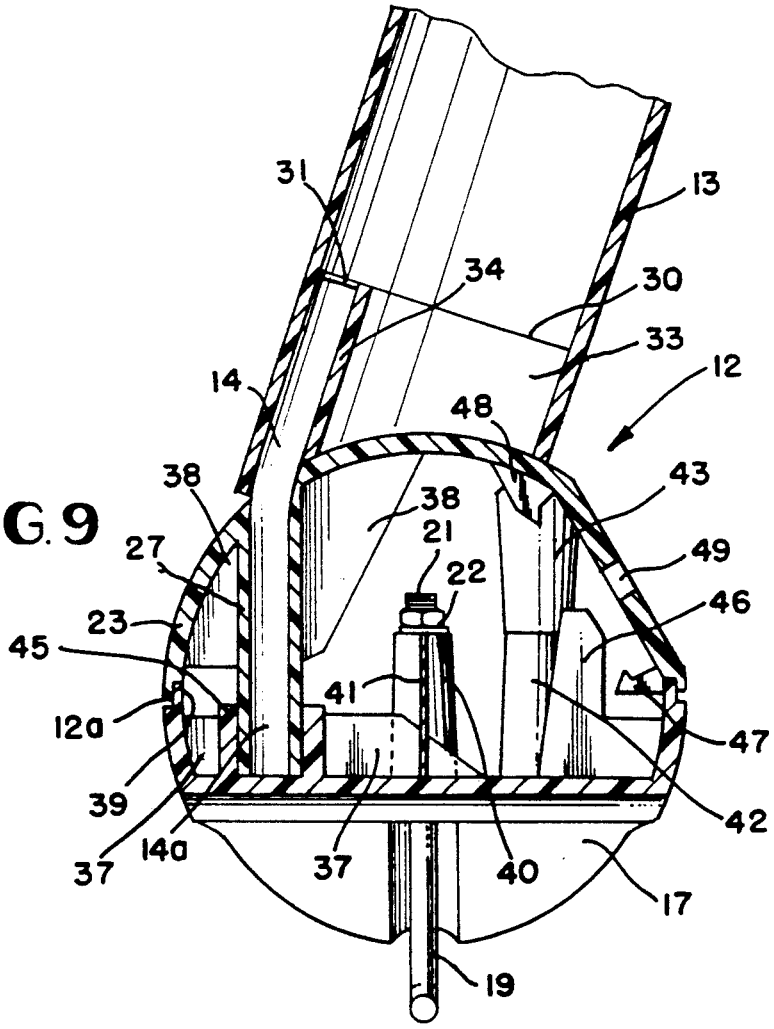
FIG. 9 shows a sectional side view of the support means.

FIG. 10 shows an example in which the tubular part 13 is made by bending a sheet of perforated steel so that its two opposite edges nearly meet and welding to those edges the upper part of the rod 14, which is outside the part 13. The rod 14 is here of circular cross-section and its lower end 14*a* is shorter than in the case of the example shown in FIG. 9 and is formed with two wings 14*b*. A central locating tube 51 in the cup-shaped part 17 receives in its interior, of circular cross-section, the lower end of the rod 14. Turning of the tubular part 13 in this case is possible and it causes the umbrella to be lifted or lowered.

In the example shown in FIG. 10 the columns 40 and 42 do not extend out of the cup-shaped portion 17 and the flange 39 and the recess to receive it are omitted.

I claim:

1. An apparatus for supporting a device from a bar comprising a clamping part for clamping on the bar, a tubular part, with a free end open for insertion and withdrawal of a portion of the device into and from the tubular part, and connecting means for connecting the clamping part to the tubular part so that the tubular part rises from the clamping part and has its free end uppermost, wherein the clamping part comprises first and second cup-shaped portions, fastening means for fastening the cup-shaped portions together to form a hollow body and a substantially U-shaped clamping member the legs of which pass through respective holes in the first cup-shaped portion into the interior of the hollow body, with the base of the U outside the hollow body and able to press on the bar to clamp the first cup-shaped portion to the bar.

2. The apparatus according to claim 1, further comprising a golfer's caddy car having a handle part for propelling the car, a bar part adjacent said handle part, a clamping part clamped on the bar part and a tubular part, extending upwardly from the clamping part and having uppermost a free end which is open.

3. The apparatus according to claim 1, wherein the ends of the clamping member are screw-threaded and carry nuts for tightening the base of the U on to the bar.

4. The apparatus according to claim 1, wherein an external recess is provided in the first cup-shaped portion which can receive part of the bar.

5. The apparatus according to claim 4, wherein the outer ends of the holes in the first cup-shaped portion lie in a locally widened part of the recess.

6. The apparatus according to claim 1, wherein the holes for the arms of the clamping member are passages through tubular columns in the first cup-shaped portion, which columns extend into the second cup-shaped portion, which columns extend into the second cup-shaped portion and are connected together by a strengthening web.

7. The apparatus according to claim 8, wherein the cup-shaped portions are such that said hollow body has an appearance somewhat like that of a golf ball, but larger than a golf ball, its surface being provided with dimples.

8. The apparatus according to claim 1, wherein the second cup-shaped portion has an elongate passageway formed in it which receives one end of a rod, the other end of which is fixed to the tubular part so that the tubular part may readily be connected to and disconnected from the second cup-shaped portion.

9. The apparatus according to claim 1, wherein said passageway is the interior of a tube of square internal and external shape which extends out of the mouth of the second cup-shaped portion and into a tube of square internal and external shape in the first cup-shaped portion.

10. The apparatus according to claim 1, wherein the fastening means are screws and one of the cup-shaped portions includes tubular columns which have internal shoulders at one end and the other ends of the internal passageways of which open at the surface of said one cup-shaped portion, heads of the screws bearing against the shoulders and the screws being screwed into tubular sockets in the other cup-shaped

11. The apparatus according to claim 1 further including a clock within the hollow body visible through a window in that body.

* * * * *